US008079487B2

(12) United States Patent
Roesler

(10) Patent No.: US 8,079,487 B2
(45) Date of Patent: Dec. 20, 2011

(54) INDIVIDUAL PACKAGING CASE FOR OBJECTS WITH FRACTURE RISK

(76) Inventor: Peter Roesler, Wangen/Allgau (DE)

( * ) Notice: Subject to any disclaimer, the term of this patent is extended or adjusted under 35 U.S.C. 154(b) by 495 days.

(21) Appl. No.: 11/382,953

(22) Filed: May 12, 2006

(65) Prior Publication Data

US 2006/0283769 A1 Dec. 21, 2006

(30) Foreign Application Priority Data

May 14, 2005 (DE) ..... 10 2005 022 385

(51) Int. Cl.
*B65D 21/02* (2006.01)

(52) U.S. Cl. ..... 220/23.89; 206/45.2; 206/349; 206/379; 206/380; 206/587; 206/588; 206/762; 211/69

(58) Field of Classification Search ..... 206/349, 206/379, 521, 587, 588, 45.2, 380, 528, 762; 220/23.89; 211/69
See application file for complete search history.

(56) References Cited

U.S. PATENT DOCUMENTS

| | | | | |
|---|---|---|---|---|
| 388,334 | A * | 8/1888 | Bartlett et al. | 206/379 |
| 5,143,218 | A * | 9/1992 | Brauckmann | 206/467 |
| 5,775,499 | A * | 7/1998 | Budert | 206/379 |
| 5,829,596 | A * | 11/1998 | Budert | 206/379 |
| 2001/0008215 | A1 * | 7/2001 | Colombo | 206/379 |

* cited by examiner

*Primary Examiner* — Anthony Stashick
*Assistant Examiner* — Elizabeth Volz
(74) *Attorney, Agent, or Firm* — Cohen & Grigsby, P.C.

(57) ABSTRACT

The invention relates to an individual packaging case for objects with fracture risk wherein the individual packaging case comprises a base with an open, upward-pointing receiving bore, into which the shank of the object with fracture risk is inserted and self-containedly protrudes from the upward-open receiving bore in the base and wherein the part with fracture risk of the object is protected by means of a protective cap pushed onto the base from above.
The invention is characterized in that the novel packaging case can be folded over an axis running perpendicular to the longitudinal axis and that due to the folding, the object to be protected becomes at least partially freely accessible.

16 Claims, 8 Drawing Sheets

INDIVIDUAL PACKAGING CASE FOR OBJECTS WITH FRACTURE RISK

CLAIM OF PRIORITY

This invention claims the benefit of German Application No. 10 2005 022 385.0, filed on May 14, 2005.

FIELD OF THE INVENTION

The subject of the claimed invention is an individual packaging case for objects with fracture risk, and specifically a packaging case comprising a pivoting axis that folds and makes the object to be protected at least partially accessible.

BACKGROUND OF THE INVENTION

The possibility of storing objects with fracture risk in an individual packaging case in such a way that there is a base of synthetic material with an open, upward-pointing receiving bore into which the shank or foot part of the object with fracture risk is inserted, is known to the art. The part of the object with fracture risk self-containedly protrudes through the upward-open receiving bore in the base and is protected from fracture by a protective cap pushed onto the base from above. In order to remove the object from the individual packaging case, first, the protective cap is pulled off, which makes the object self-containedly inserted into the base accessible and able to, for example, be pulled out manually.

Individual packaging cases of this type have proven themselves, though they have the disadvantage of being relatively complicated to handle. Since the object with fracture risk protrudes upwardly and self-containedly from the receiving bore in the base, the danger exists that if the protective cap is pulled off at a slant, the protective edge may touch the object with fracture risk and may even, in the worst case, break off the object.

A further disadvantage lies in the fact that the object is not optimally protected from fracture due to the self-contained fixation of the object with fracture risk. If, for example, a packaging case of this type is dropped to the floor unintentionally, the danger exists that the object may break off due to the self-contained fixture.

The third disadvantage lies in the fact that the object has to be manually removed from the container by the very place that needs to be protected, namely, for example, in the area of the place with fracture risk, which again is associated with the danger of damaging the object.

Strong holding forces are particularly needed in the area of the base in order to prevent the object to be held from unintentionally sliding out of the base while in the packaged state. The strong holding forces, however, are disadvantageous, particularly when the object with fracture risk has to be removed from the base after the protective cap is pulled off, because a considerable manual or traction force needs to be exerted on the object with fracture risk in order to pull the object upward out of its clamping fixture. The relatively strong traction forces also create the danger that the object with fracture risk is buckled or tilted, which again creates the danger of damaging the object.

An additional disadvantage of the packaging case known in the art lies in the fact that it is not possible to directly insert the object, for example, into a tool holding fixture after pulling off the protective cap without touching the object with a hand. The object has to be manually removed from the packaging case by the very part which is at risk for fracture and to be inserted into a tool clamping fixture with the opposing end by holding the bit which is at risk for fracture. This handling system is not safe in operation and leads to damage of objects, particularly when the objects are of a thin and/or fragile construction.

OBJECTS AND SUMMARY OF THE INVENTION

For the sake of simplicity, the following description will show in more detail an embodiment in which the elongate object with fracture risk is constructed as a drill with fracture risk (e.g. a dentist's drill or a micro-drill). However, the invention is not limited to this. The invention relates to an individual packaging case for all known objects with fracture risk, and in particular, to glass ampoules, synthetic material, wood, or other objects, including metal/wood or metal/synthetic material composite objects, all of which are at risk for fracture. Furthermore, the invention is not limited to elongate objects, since there are also applications in which non-elongate objects with fracture risk are stored with operational safety in an individual packaging case, are protected from destruction while in packaged state, and can undergo removal with particularly good operational safety.

The invention therefore has the object of designing an individual packaging case for objects with fracture risk of the aforementioned type in such a way that in the packaged state, the object with fracture risk is held securely without vibration, is protected against fracture, and is able to be removed from the packaging case with particularly good operational safety.

The stated object is achieved according to the invention as characterized by the enabling disclosure of claim 1, and specifically a packaging case comprising a pivoting axis that folds and makes the object to be protected at least partially accessible. A substantial feature of the invention lies in the fact that the novel packaging case can be folded over an axis running perpendicular to the longitudinal axis, wherein the folding makes the object to be protected at least partially freely accessible.

In a preferred example, the packaging case comprises at least one holder forming at least one receiving groove which is open toward the front on at least one side and in the area of which the object to be protected and to be held is placed. A crosscut disposed substantially perpendicular to the receiving groove in the area of the receiving groove is disposed in the holder, the crosscut forming a single-sided pivoting axis located at one wall of the holder and essentially oriented perpendicular to the longitudinal axis of the receiving groove. The claimed invention has the advantage of providing a holder having a receiving groove which is open at least toward the front and into which the object to be held is placed. hi this case, it is preferred to have the receiving groove constructed approximately as a U-shaped groove that envelops the object to be held on at least three sides or surfaces in order to ensure a convenient envelopment of the object to be protected. The three walls of the receiving groove hold the object securely and protect against damage and vibration. However, the invention is not limited to this. In an example of an embodiment, the receiving groove may be constructed with a cross-section in a C-shape or L,-shape so that the object to be held is enveloped on only two sides or surfaces.

In an example of yet another embodiment, the receiving groove may be constructed in a cone-shape, i.e. the object to be held is held on only two opposite walls, while the bottom of the receiving groove is constructed with an acute angle, such that the object to be held is automatically centered in the receiving groove. which is constructed as a V-shape and thus rests flush against the walls disposed at an angle to one another.

In an example, it is important that the area of the receiving groove (e.g., about the lower third of the length of the receiving groove) contains a crosscut interrupting the receiving groove and cut into the holder perpendicularly to the receiving groove in order to form a pivot bearing for the holder such that the receiving groove is interrupted and the holder is divided into an upper part and a lower part (or a base) pivotably attached thereto. The connection between the upper part and the lower part of the holder is preferably generated by a film hinge constructed in a horizontal pivoting axis at the rear side of the holder. This makes it possible to fold the packaging case over. When the description of the location talks about a "horizontal axis," it is assumed that the receiving groove is oriented in a vertical direction In different situations, of course, the description of locations applies in an analogous fashion.

The term "film hinge" is not to be understood as limiting. A film hinge is preferred in cases where the holder is manufactured from a synthetic material. It is particularly easy to provide a film hinge of the synthetic material on the holder because this is particularly easy to construct using the injection molding procedure. The invention, however, is not limited to the disposition of a film hinge because other pivoting means or mechanisms are also possible. For example, an elastically bendable metal or spring part may be built into the synthetic material of the holder in the area of the crosscut, the metal part snapping backwards due to a spring action and also able to be brought back into a closed position by the spring action. Thus, in an example, there is a hinge which can be brought into a closed position with the aid of a bending metal part, and into an opened position against the spring force of the bending metal part.

In another example of the embodiment, the holder is constructed in two parts comprising an upper part, a lower part or a base, and an inserted bending metal part disposed at the rear wall in the area of the crosscut separating the upper part from the lower part, the bending metal part connecting the upper and the lower parts and there forming the pivoting axis. By disposing a crosscut and a film hinge disposed thereon, however, the construction of the holder from a synthetic material part leads to the achievement of optimally little tool use with optimally low cost so that the further description describes this embodiment in more detail. It is of importance that the construction of the holder in the manner described generates substantial advantages in relation to the prior art. Since the object with fracture risk to be held is placed into a receiving groove in its entire length, an advantage of the claimed invention is that the object is also supported effectively against vibrations and fracture along its entire length in the receiving groove. In the simplest case, the holding fixture of the object with fracture risk in the receiving groove is designed in such a way that the object is held in the receiving groove in a way to be easily slidable and that the upper end of the holder is covered by a protective cap encircling the holder on four sides, thereby providing a circumferential protection for the holder. The object cannot be moved forward out of the receiving groove in the direction of the longitudinal extension thereof without force until the protective cap is pulled off the holder. The object thus is held freely slidably in the receiving groove and can be shaken out of the receiving groove after the protective cap is pulled off. The object then drops out forward in the direction of the longitudinal extension of the receiving groove, but can also be removed in the forward direction out of the receiving groove, which is open toward the front.

Naturally, the invention is not limited to the disposition of a protective cap surrounding and enveloping the holder. Instead of a protective cap, a protective flap can also be used which covers the receiving groove and which is also attached to the holder by means of a hinge. The protective flap can also be attached to the holder by means of a releasable attachment such as an adhesive attachment. The protective flap may also be spray-applied in the area of a film hinge at the upper end of the holder in a way to be pivotable on one side in order to form a protective lid which can be pivoted onto the holder to cover the receiving groove. Instead of a lamella-type pivotable lid, of course, a self-sticking adhesive label can be used wherein the lid forms the pivot bearing on the holder. In another example, a self-sticking adhesive label covering the receiving groove is used instead of a lamella-type lid of synthetic material.

In an example of another embodiment, the holder is equipped with a so-called sliding lid again covering the receiving groove toward the front in order to prevent the object to be held from dropping out. In this case, there is a lamella-type lid of synthetic material held in a slide groove oriented in the direction of the longitudinal extension of the receiving groove.

All embodiments show that it is not absolutely necessary for achieving the object of the invention to use a protective cap because there is a multitude of other possibilities for preventing the object with fracture risk to be held from dropping out of the receiving groove which is open at least toward the front. It is only of importance for the invention that a so-called "fold and pivot" holder is created, wherein the holder is equipped with at least one crosscut in the area of the receiving groove, the crosscut forming at its rear end a pivoting axis for pivoting the upper part of the holder. Naturally, the invention is not limited to the disposition of one single crosscut with a pivoting axis disposed in the rear area.

In an example of another alternate embodiment, more than one crosscut is disposed at a distance from one another, each cross-cut forming a pivoting axis in the rear area so that, in accordance with the crack and pivot principle according to the invention, various parts of the holder one after the other are pivoted backward by crack and pivot movements, thereby step by step making the object to be held accessible. In the above description, it was explained that the object with fracture risk to be held is held only loosely in the receiving groove of the holder and is then released by pivoting away one part of the receiving groove in the area of the crosscut.

An example of another embodiment of the invention, however, provides that the object with fracture risk is held in the receiving groove on at least one side by a clamping fixture so that the object is still held in one part when the other part of the holder with its clamping fixture is pivoted away. Preferably, this is provided in the way that the part of the object to be held without fracture risk is held in the holder in the form of a clamping fixture and that when the upper part of the holder is pivoted away, the part of the object to be held with fracture risk is released, thereby ensuring easy removal. Naturally, the invention is not limited to this, because a reversal of the effect of this principle may provide that it be the very part with fracture risk that is held in the form of a clamping fixture and that the part without fracture risk is resting loosely in the holder (in the area of the receiving groove). If the holder is opened by being pivoted away in the area of the crosscut, the part of the object without fracture risk becomes freely accessible and the end without fracture risk of the object can be inserted into a tool clamping fixture or into another holding device, for example. The part with fracture risk then remains protected in the packaging case up to the end (until the object is received by the tool holding fixture) and is not removed from the clamping fixture of the holder until use.

It should be emphasized again that the present invention provides both clamping fixtures, namely, the clamping fixture of the part with fracture risk as well as the clamping fixture of the part without fracture risk. The present invention also relates to the arrangement of two clamping fixtures disposed at a distance from one another and receiving not only the part of the object with fracture risk, but also the part of the object without fracture risk in the form of clamping. In one example of this embodiment, the clamping force in one clamping fixture is different from the clamping force of the other clamping fixture. In an example, the clamping fixture can also be combined with other position-securing devices. For example, it may be provided that the clamping fixture be combined with a position-securing device such as a safety device against axial displacement of the object. A position-securing device of this type may, for example, be formed by a contact shoulder securing the object with fracture risk against any longitudinal displacement in the receiving groove. As described above, there may be a fold-pivot movement in the area of the crosscut of the holder. As described below, there may be a "crack-pivot movement." The general enabling disclosure of the invention (foldable packaging case) relates to the fact that a simple pivot bearing is disposed in the area of the crosscut in order to ensure free pivoting of an upper part of the holder in relation to the lower part. A pivot bearing of this type assumes that the upper part can always be pivoted back into the home position against the lower part once the crosscut is opened. Therefore, this is a pivot bearing closed with zero force and able to be opened and closed repeatedly. This embodiment, however, does not use the aforementioned "crack-pivot" movement.

In a second example of an embodiment, the novel movement relates to the fact that the pivot bearing is furnished with a pivot safety device which has to be overcome (possibly by a crack sound) at the time of the initial opening of the pivot bearing, wherein after overcoming the safety device, the pivot bearing can be pivoted. An advantage of this embodiment lies in the fact that during manufacture of a holder of this type, the holder is constructed with a basic rigidity without which the danger would exist that the upper part unintentionally pivots away from the lower part. A further advantage of this embodiment lies in the fact that during initial opening of the packaging case (e.g. when pulling off the protective cap) the device can be operated with great safety. When the cap is pulled off of containers in the prior art, the cap may be tilted, thereby causing the upper part unintentionally to be pivoted in relation to the lower part in the area of the pivoting axis, whereby the object with fracture risk is unintentionally lifted out of its receiving groove and, for example, is damaged on the interior side of the protective cap to be pulled off. The present invention eliminates this risk by providing a container that retains the basic rigidity during initial pull-off of the protective cap so that even when the protective cap is pulled off by tilting, the danger does not arise that the upper part is already pivoted unintentionally in relation to the lower part. In an example of the claimed invention, the so-called "cracking" of the pivot joint occurs, wherein two knob connections of synthetic material are preferably disposed in the pivoting area of the pivot joint, the connections being destroyed during initial pivoting of the pivot joint in order to achieve the described "crack" effect. An additional advantage of the claimed invention is that the so-called "crack" safety device ensures that the packaging case of the holder has not yet been opened. The object can practically be removed from the holder only by pivoting the upper part away from the direction of the lower part, and once the "crack" joint has been destroyed, it is easy to recognize thereafter that the object has already been removed once before.

The present invention is not limited to each one holder as an individual packaging case for objects with fracture risk, because more than one packaging case can also be disposed in sequence in the form of a magazine and connected with one another by means of corresponding film hinges or other synthetic material connections, as described below in the drawing examples.

The subject of the present invention does not ensue only from the subject of the individual patent claims, but also from the combination of the individual patent claims with one another. All information and features disclosed in the documentation, including in the abstract, in particular, the spatial structure shown in the drawings, are claimed as substantial to the invention insofar as they are novel individually or in combination in relation to the prior art. The innovation is described in more detail below with reference to drawings showing several embodiments. In this context, further features and advantages of substantial significance to the invention ensue from the drawings and their descriptions.

BRIEF DESCRIPTION OF THE DETAILED DRAWINGS

DETAILED DESCRIPTION OF EXAMPLES OF EMBODIMENTS OF THE INVENTION

Figure 1:
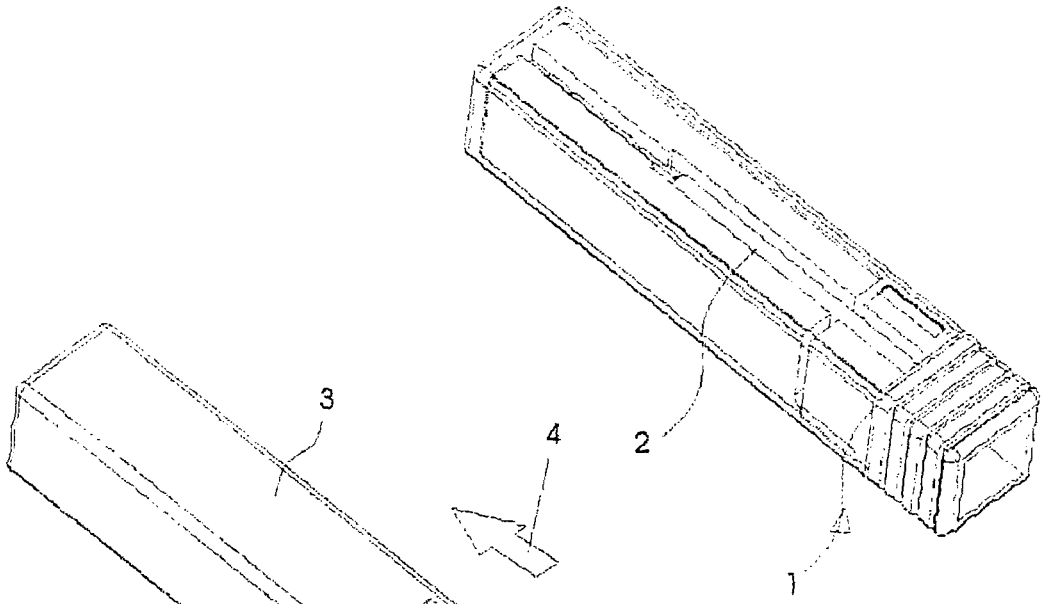
FIG. 1 shows a perspective view of an example of an embodiment of an individual packaging case in the finished state.
Figure 2:
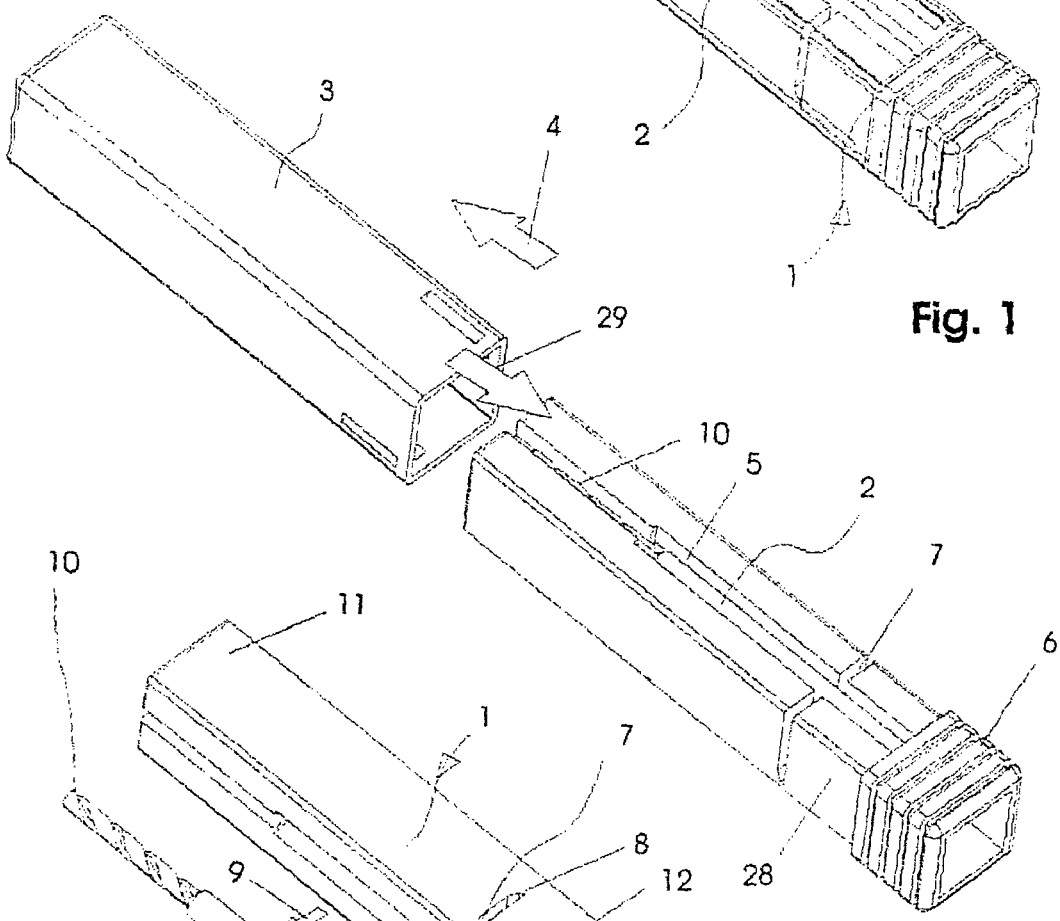
FIG. 2 shows a perspective view of the packaging case according to FIG. 1 as the protective cap is being pulled off.
Figure 3:
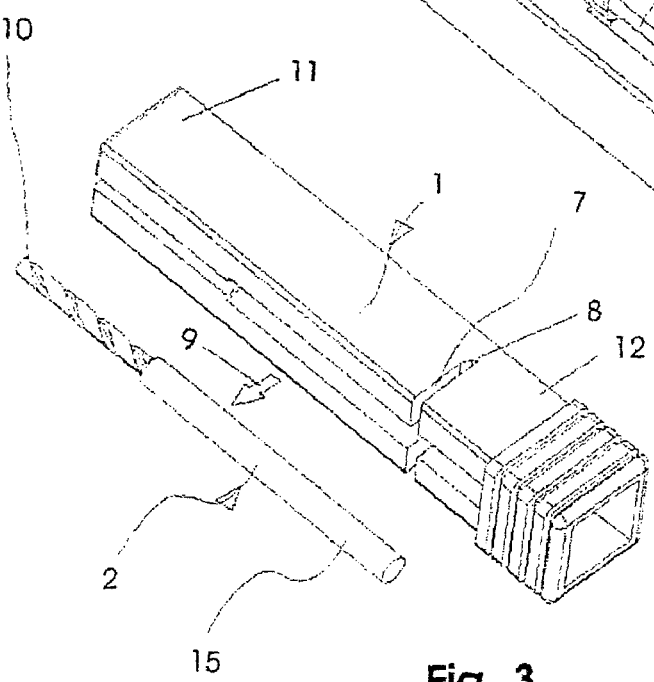
FIG. 3 shows a perspective view of the packaging case according to FIGS. 1 and 2 as the object is being removed.

In a preferred example of an embodiment the invention, the holder 1 is manufactured of a synthetic material, although the invention is not limited to this. It is also possible to provide that the holder 1 be manufactured of a metal material, in particular, a light metal alloy, or wood, or a composite material consisting of several material composites.

In an embodiment described below, the holder 1 comprises an injection-molded part made of synthetic material and serves to receive an object 2 with fracture risk comprising in the preferred embodiment a very filigree drill for dental medicine. In an example, the object 2 has a bit 10 with fracture risk.

A receiving groove 5 extending in a longitudinal direction is formed into the holder 1, the receiving groove receiving the object 2, wherein the reception of the object 2 in the receiving groove 5 can occur in various embodiments according to at least the general description:

1) loose reception of the object 2 in the receiving groove 5;

2) clamping reception of the object 2 in the receiving groove 5;

2a) clamping reception is formed in the area of the part without fracture risk of the object 2, namely, in the area of the shank 15;

2b) clamping reception is formed in the area of the bit 10 with fracture risk;

2c) clamping reception is formed in the area of the bit 10 and in the area of the shank 15;

2d) clamping reception is formed in the area of the shank 15, and a stop shoulder 19 protecting against axial displacement is disposed in the area of the bit 10.

The aforementioned possibilities of combination 2a through 2d may be freely combined among one another.

In the examples of the embodiment shown, the holder 1 is enclosed by a protective cap 3 which can be pulled off in direction of the arrow 4 in order to prevent the object 2 from dropping out of the receiving groove 5. The embodiment provides that the object 2 be held only loosely in the receiving groove 5. When the protective cap 3 is pulled off in direction of the arrow 4, therefore, the object 2 can easily be shaken out of the receiving groove 5 in direction of the arrow 9. For the purpose of pulling off the protective cap 3, the base or lower part 12 of the holder 1 has a handling device 6 of enlarged diameter which has handling grooves.

Figure 4:
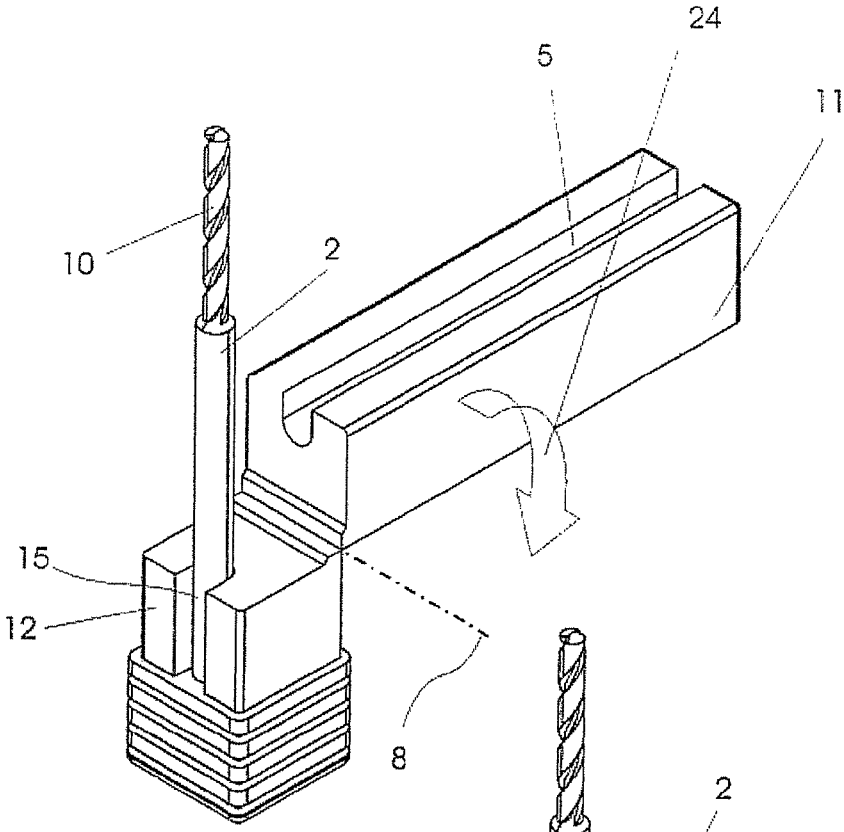
FIG. 4 shows a perspective view of the packaging case according to FIG. 3 as the holder is being pivoted.

In an example, at least one crosscut 7 forming a pivoting axis 8 with a rear wall of the holder is located in the area of the holder 1. This feature is shown in detail in FIGS. 4 and 5. In order to remove the object 2 from the holder 1, therefore, the upper part 11 is pivoted away from the lower part 12 in the direction of arrow 24 in the area of the crosscut 7, which leads to pivoting around the pivoting axis 8 in the area of the film hinge 13, the film hinge being formed onto the rear wall of the holder 1 between the upper part 11 and the lower part 12. Consequently, the bit 10 with fracture risk moves out of the engagement with the receiving groove 5, which due to the crosscut 7, is divided into a lower part of the receiving groove 5*a* and an upper part of the receiving groove 5*b*.

The lower part 12 is clearly enlarged in relation to the upper part 11, in order to ensure that only the lower part of the protective cap 3 acts in conjunction with snap-in protrusions 29 disposed there with coordinated snap-in knobs 28 in the area of the lower part 12 of the holder 1. Consequently, only the lower part of the protective cap 3 rests against the lower part 12 of the holder 1, snapped-in and in positive fit, while the protective cap 3 is held at a distance from the upper part 11 and in a way to be easily slidable. Consequently, the protective cap 3 can be pulled off the lower part 12 easily and without risk, without the pull-off leading to a clamping or friction effect at the upper part 11.

Figure 5:
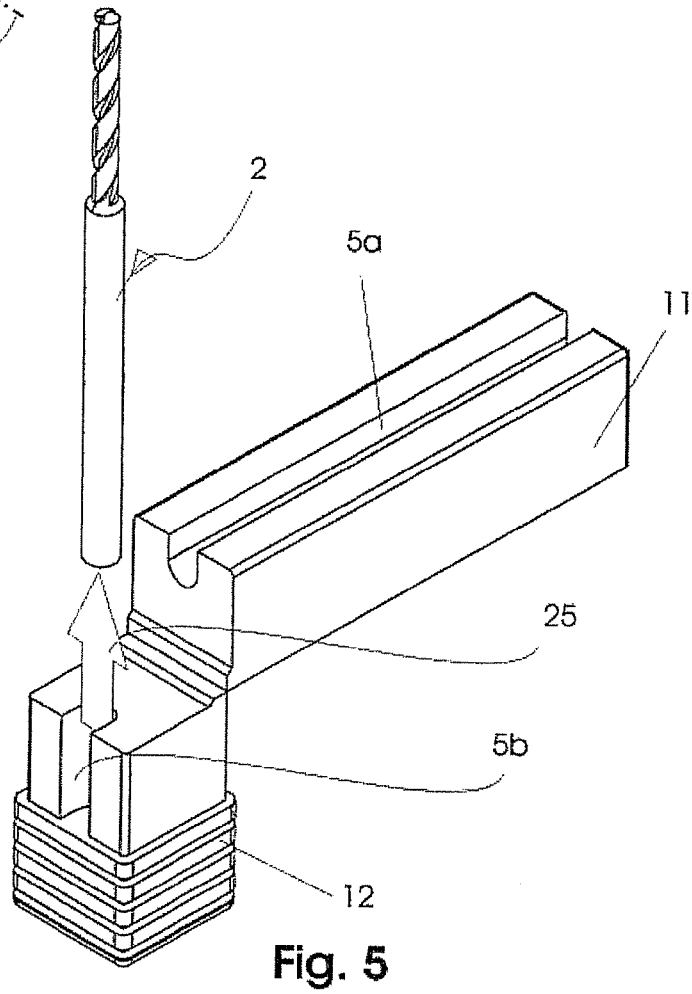
FIG. 5 shows a perspective view of the case according to FIG. 4 as the object is being removed.

FIG. 5 shows that the shank 15 of the object 3 with fracture risk remains in the receiving groove 5*b* and, for example, is held there by a fixture not shown in detail The object therefore can be pulled out upward in direction of the arrow 25. In this example, it is preferred not to touch the bit 10 of the object 2 with fracture risk, but rather the shank 1 5 without fracture risk.

It is not required for the claimed invention to attach a fold safety device 14 in the area of the pivoting axis 8 of the film hinge 13. However, a fold safety device 14 of this type is explained in more detail in the following description of the FIGS. 6 through 10.

Figure 6:
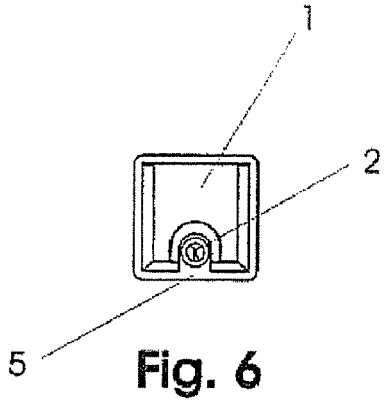
FIG. 6 shows a top view of the end of the holder according to FIG. 7.

First, FIG. 6 shows that the receiving groove 5 envelops the object 2 to be held as far as possible on three sides, in order to hold the object as free from displacement and protected from vibrations as possible.

Figure 7:
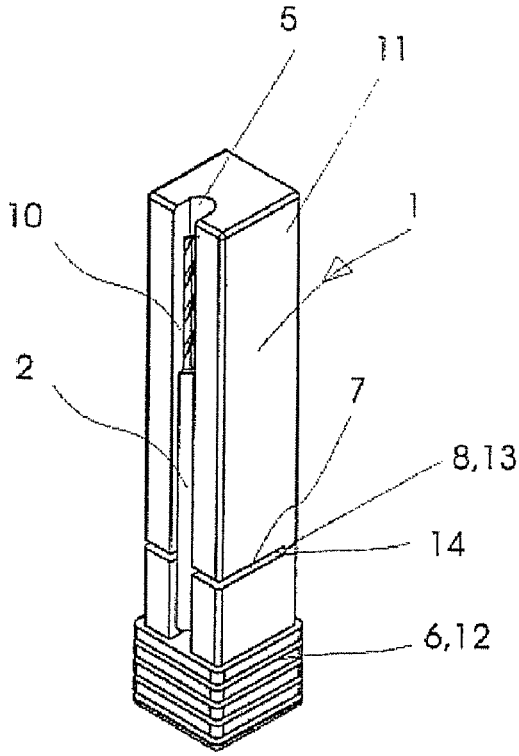
FIG. 7 shows a perspective view of an example of the claimed holder while the object is being held.
Figure 8:
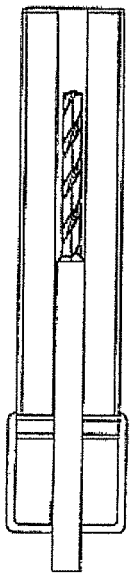
FIG. 8 shows a lateral view of the arrangement according to FIG. 9.
Figure 9:
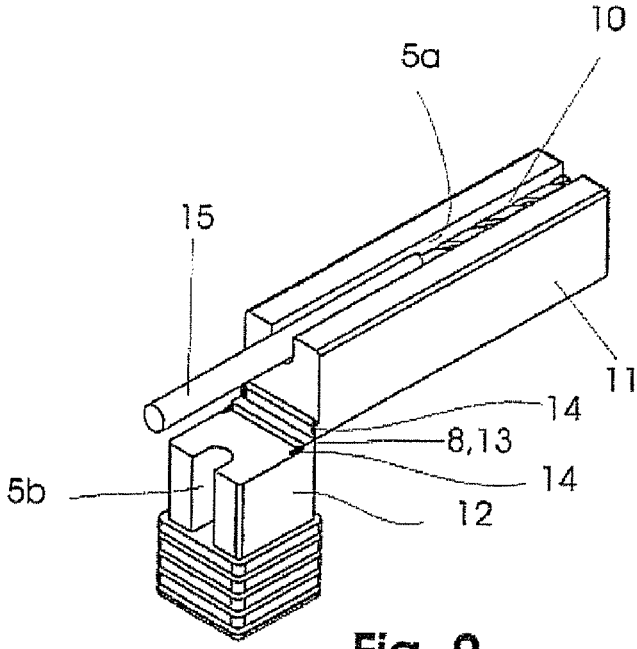
FIG. 9 shows a perspective view of an example of an embodiment of an open holder.

FIG. 7 shows that in the area of the crosscut 7 in front of the pivoting axis 8 and film hinge 13, a so-called fold safety device 14 is formed into the synthetic material between the upper part 11 and the lower part 12. The fold safety device has to be broken between the upper part 11 and the lower part 12 during opening or pivoting, as shown in FIG. 9. The fold safety device 14 comprises dots of synthetic material, interconnected in the original state, to be broken during pivoting between the upper part and the lower part 11, 12, as shown in FIG. 9. When "cracking" of the holder occurs, i.e. during pivoting between the upper part and the lower part, the film hinge 13 is pivoted, while the fold safety device 14 is being simultaneously destroyed. This makes an initial and single opening of the holder 1 clear because the fold safety device 14 can no longer be restored.

In an example of the embodiment shown, the object 2 to be held is held in the form of a clamp fixture, not shown in detail, in the upper area of the receiving groove 5*a* so that the bit 10 with fracture risk remains in the receiving groove 5*a*, while the shank 15 without fracture risk becomes freely accessible. According to FIG. 10, therefore, the entire holder 1 with the shank 15 protruding upward can be clamped into a clamping tool 16 in the direction of the arrow 17 without the need for touching the bit with fracture risk. The holder I then is simply pulled off downward in the opposite direction of arrow 17.

Figure 10:
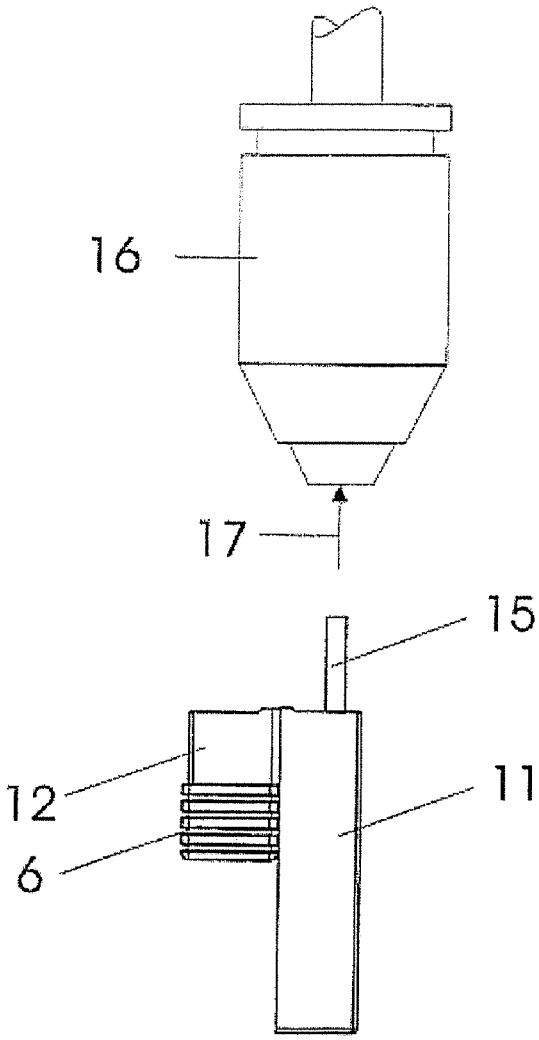
FIG. 10 shows the transfer of the object to be held from the holder of FIG. 9 into a tool clamping device.
Figure 11:
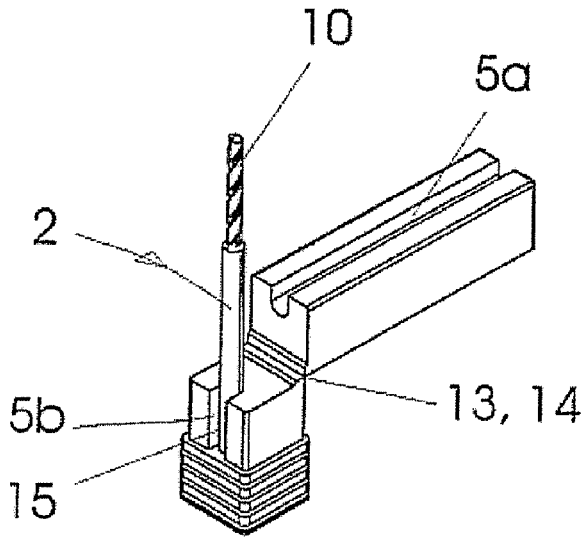
FIG. 11 shows an example of an alternate embodiment of the clamping fixture of the object compared to the example of the embodiment shown in FIG. 9.
Figure 15:
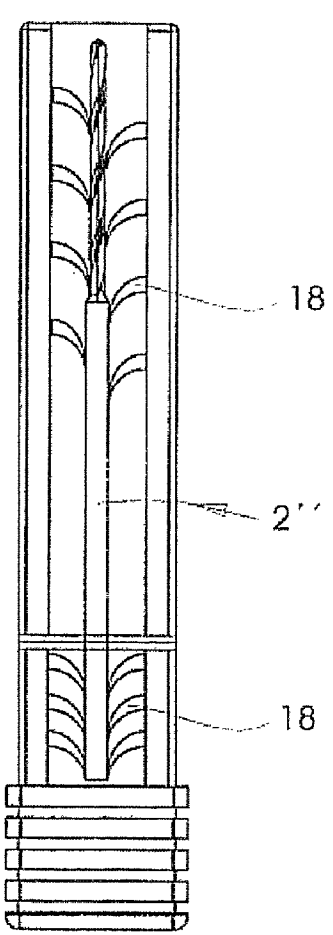
FIG. 15 shows an example of a third embodiment of a packaging case having clamping means.

FIG. 11 shows the kinematic reversal of the embodiment according to FIGS. 9 and 10, where it can be seen that a clamp fixture, not shown in detail, is now disposed in the area of the lower receiving groove 5*b* and upon "cracking" of the packaging case, pivots the receiving groove Sa upward and away, thereby making the part with fracture risk of the object 2 accessible.

Figure 14:
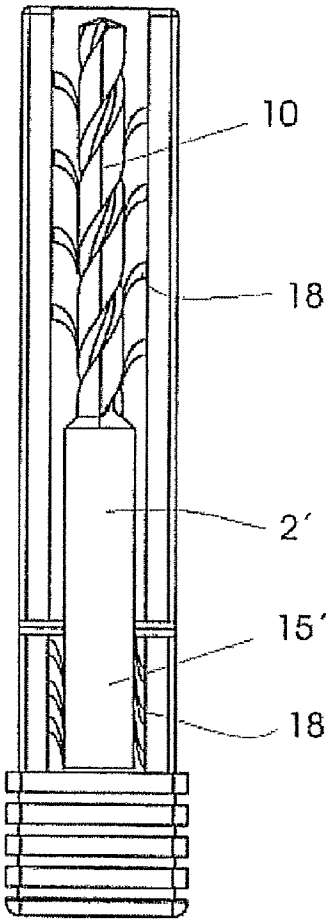
FIG. 14 shows a lateral view of an example of a second embodiment of clamping means for fixing another object.
Figure 13:
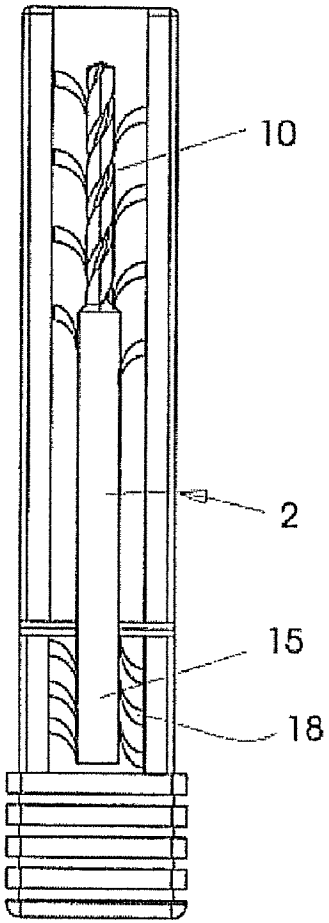
FIG. 13 shows an example of a lateral view of the packaging case according to FIG. 12 holding an object.
Figure 12:
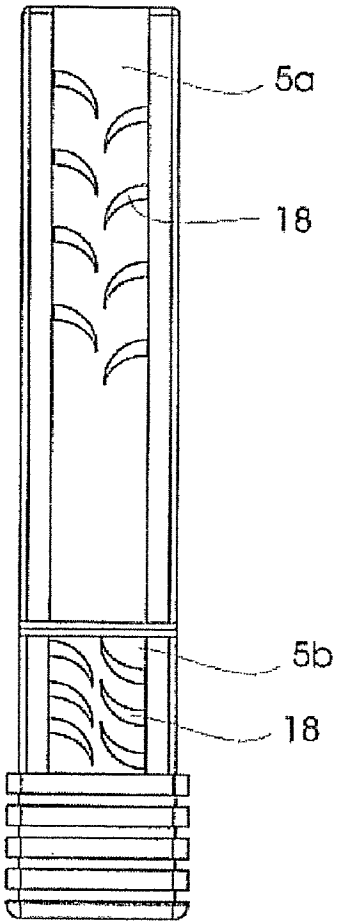
FIG. 12 shows a lateral view of an example of an embodiment of a holder with clamping means.

FIGS. 12 through 15 show various embodiments of clamp fixtures, while clamp fixtures of this type already are part of the prior art and can be replaced by other clamp fixtures. FIG. 12 shows that the clamping means 18 are formed by elastically bendable strips, wherein the strips in the upper area of the receiving groove 5*a* are turned downward, while the strips of the clamping means 18 in the lower area of the receiving groove 5*b* are turned in the opposite direction. FIG. 13 shows the manner in which an object 2 is fixed by means of the clamping means 18. FIG. 14 shows an example of another embodiment, wherein the clamping means are disposed in the same direction, in order to hold another object 2'. Since the clamping means 18 are the same, therefore, objects 2, 2', 2", having substantially different diameters can be held. Instead of the clamping strips shown here, clamping knobs and other clamping means known to the art may be used as well. It is therefore only important to have a fixture with force-closed fit of the object 2, 2', 2" to be held.

Figures 16, 17, 18, 19, 20, 21:
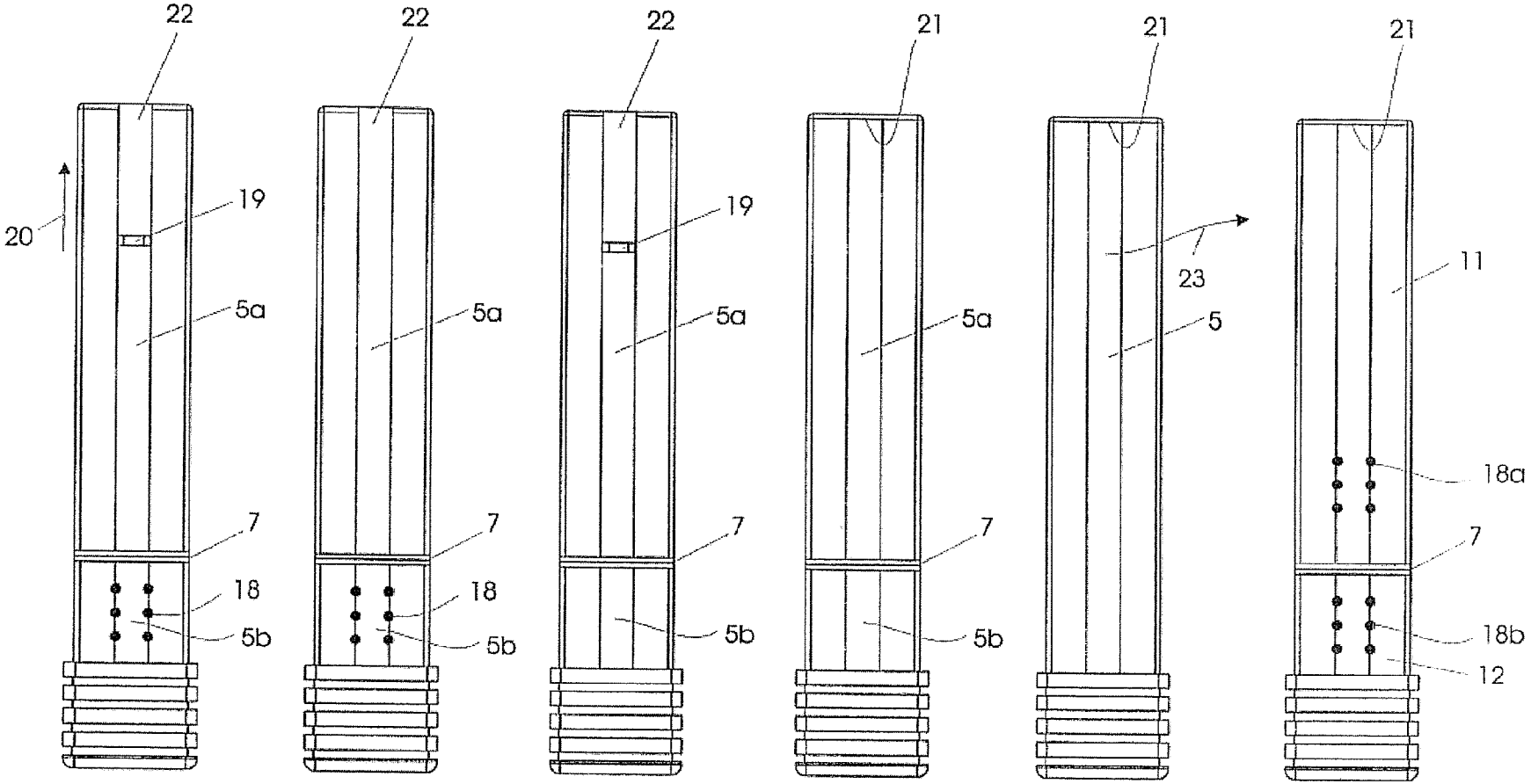
FIGS. 16 through 21 show lateral views of examples of clamping fixtures in combination with slide safety devices in packaging cases according to the claimed invention.

FIGS. 16 through 21 show various examples of combining clamping means 18 in comparison with the so-called stop shoulder 19, which prevents a longitudinal displacement of the object to be held in the direction of the longitudinal extension of the receiving groove 5. In this context, FIG. 16 shows that clamping means 18 comprising clamping cams are disposed in the area of the lower receiving groove 5 and that in the area of the upper receiving groove 5*a*, a stop shoulder 19 rests against the end of the shank thus holding the shank in a way to be protected against displacement, wherein the part with fracture risk is located either on the other side of the contact shoulder 19 or is disposed in the area of the contact shoulder 19. In this manner, displacement of the object to be held in direction of the arrow 20 as well as in opposite direction is prevented.

FIG. 17 shows that a contact shoulder 19 of this type may also be omitted, and FIG. 18 shows that the clamping fixture with the clamping means 18 may also be omitted, while only a contact shoulder 19 remains. FIG. 19 shows that both fixture securing devices may be omitted, and FIG. 20 shows that the object to be held can also be laterally removed from the receiving groove 5 in direction of the arrow 23.

Within the framework of the general description, it was already noted that the receiving groove does not necessarily envelop the object to be held on three sides. A receiving groove of L-shape or C-shape or V-shape may also be provided.

FIGS. 16 and 18 show that the receiving groove 5 has an opening 22 in upward direction allowing the object to be secured to be removed in direction of the arrow 20. FIGS. 19 through 21, on the other hand, show that the receiving groove 5 has a closed end 21 so that the object to be held can only be removed in crosswise direction to the longitudinal extension of the receiving groove 5.

FIG. 21 shows that it is also possible to dispose not only clamping means 18*a* in the upper part 11, but also clamping means 18*b* in the lower part 12 of the holder 1, wherein it is preferred for the clamping means 18*a*, 18*b* to have different clamping effects.

Figure 22:
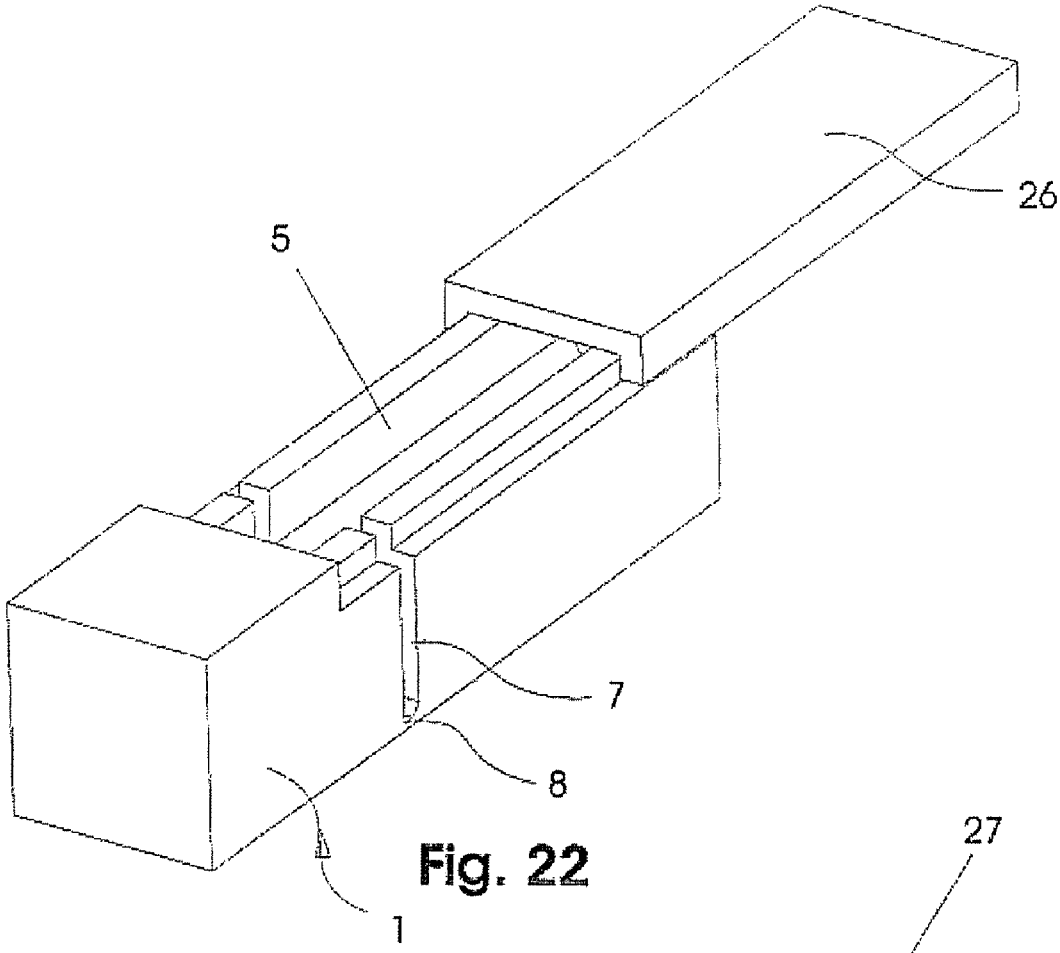
FIG. 22 shows the perspective view of an example of a holder with a sliding lid.
Figure 23:
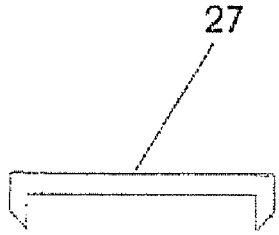
FIG. 23 shows a perspective view of an example of an adhesive label that may be used to replace the sliding lid.

FIG. 22 shows that instead of a protective cap 3, a sliding lid 26 may be used to serve as closure for the receiving groove 5. FIG. 23 shows that not only the protective cap 3, but also the sliding lid 26, may be omitted and replaced by a simple adhesive label 27 glued over the receiving groove 5. When the holder 1 is crack-pivot opened, therefore, the adhesive label 27 is irreparably destroyed, thus also serving as guarantee safety device. Naturally, an adhesive label 27 can also be combined with a sliding lid 26 and/or a protective cap 3.

Figure 24:
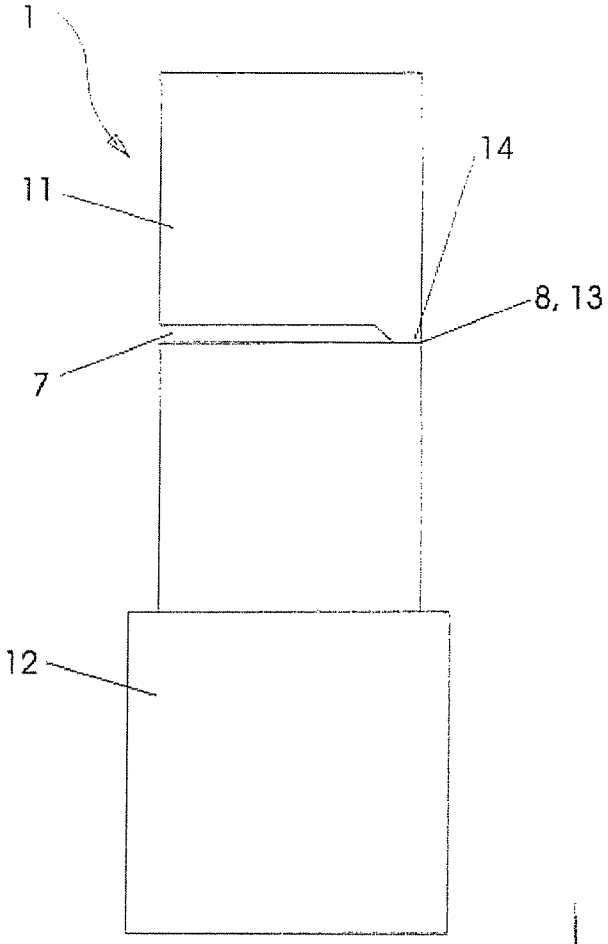
FIG. 24 shows an enlarged lateral view of the lower area of an example of a holder.
Figure 25:
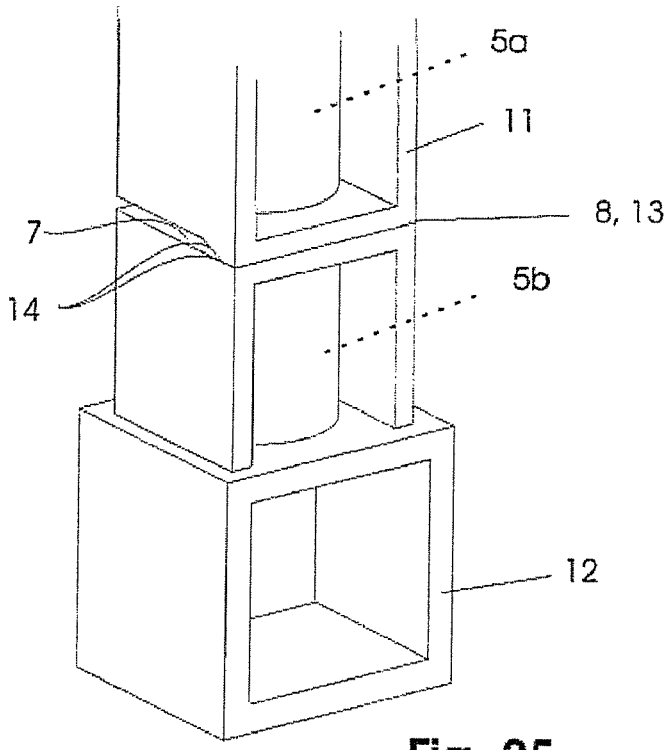
FIG. 25 shows a perspective rear view of the holder according to FIG. 24.

FIGS. 24 and 25 again show the function of the fold safety device 14 in enlarged representation. Here, it can be seen that in the area of the pivoting axis 8, the film hinge 13 is disposed on a rear wall between the upper part 11 and the lower part 12, and that knob-like fold safety devices are disposed forward-pointing in direction of the crosscut 7, the safety devices representing connective knobs in the pivotable part of the film hinge 13. If then the film hinge is pivoted, first, the fold safety devices 14 in the form of synthetic material connections are destroyed in order to then allow the film hinge 13 to move into open position.

While the foregoing has been set forth in considerable detail, it is to be understood that the drawings and detailed embodiments are presented for elucidation and not limitation. Design variations, especially in matters of shape, size, and arrangements of parts, may be made but are within the principles of the invention. Those skilled in the art will realize that such changes or modifications of the invention or combinations of elements, variations, equivalents, or improvements therein are still within the scope of the invention as defined in the appended claims.

List of Reference Characters

1 holder
2 object 2', 2"
3 protective cap
4 direction of arrow
5 receiving groove 5*a*, 5*b*
6 handling device
7 crosscut
8 pivoting axis
9 direction of arrow
10 bit
11 upper part
12 lower part
13 film hinge
14 fold safety device
15 shank
16 clamping tool
17 direction of arrow
18 clamping means 18*a*, 18*b*
19 stop shoulder
20 direction of arrow
21 end
22 opening
23 direction of arrow
24 direction of arrow
25 direction of arrow
26 sliding lid
27 adhesive label
28 snap-in knobs
29 snap-in protrusions

I claim:

1. A case for packaging individual objects that have a fracture risk portion and a shank portion, said case comprising:

a holder that defines a groove along a longitudinal axis, said holder laterally receiving the entire length of one of said objects in said groove, said holder including;

a. a base that defines an upward-pointing receiving bore that is located on a longitudinal axis, said receiving bore adapted to receive the shank end of said object such that the remaining portion of said shank protrudes from said upward-pointing, receiving bore, b. an upper part that defines an open groove along a longitudinal axis, said open groove adapted to laterally receive the fracture risk portion of said object and also to laterally receive part of the shank of said object that protrudes from the receiving bore of said base, and c. a pivotal connection that is attached to one end of said upper part and to the end of said base that opens to said upward-pointing, receiving bore, said pivotal connection having a pivotal axis that is perpendicular to the longitudinal axis of the receiving bore and to the longitudinal axis of the groove of said upper part such that said base and said upper part are pivotal between a closed position wherein the longitudinal axis of the groove of said upper part is in line with the longitudinal axis of the receiving bore of said base and an open position wherein the longitudinal axis of the groove of said upper part is pivoted away from the longitudinal axis of the receiving bore of said base;

a first clamping fixture that is located in said receiving bore of said base, said first clamping fixture holding said shank portion in said upward-facing bore defined by said base;

a second clamping fixture that is located in said open groove that is defined by said upper part, said second clamping fixture laterally receiving said object and holding said object in said open groove defined by said upper part; and a protective cover that slides over said upper part and unto at least a portion of said base at times when said base and said upper part are in said closed position, said protective cover extending over all of said receiving groove whenever it covers at least a portion of said base.

2. A case according to claim 1, wherein the groove defined by said holder is constructed as one of the following:

a. an approximately U-shaped groove that envelops said object on at least two surfaces;

b. an approximately C-shaped groove that envelops said object on at least two surfaces;

c. an approximately L-shaped groove that envelops said object on at least two surfaces; or d. a conical shape that holds said object on two opposite walls, said object resting against said walls disposed at an angle to one another in said groove.

3. A case according to claim 1 wherein said object is slidably received in the groove of said holder along an entire length, and wherein said object can be manually removed in a direction of a longitudinal extension of said receiving groove.

4. A case according to claim 1 wherein said first clamping fixture that is located in said base has a different clamping force than the clamping force of said second clamping fixture that is located in said open groove that is defined by said upper part.

5. A case according to claim 1 wherein a plurality of said holders for said object are disposed in a sequence and are connected by means of a pivoting connection.

6. A case according to claim 1 wherein said protective cover extends over said base, said pivotal connection, and said upper part to cover said receiving groove, said protective cover having a part that abuts the base of said holder when said cover is pushed onto said holder.

7. A case according to claim 6 wherein said object is capable of sliding into the groove of said holder and wherein said protective cover is a protective cap that covers the side of said holder where said groove is defined, said cap enveloping said holder on four sides to form a circumferential protection for said holder.

8. A case according to claim 1 wherein said holder includes a crosscut in the area of the groove of said holder where said pivotal connection is located, said crosscut running substantially perpendicular to the groove of said holder, said pivotal connection defining a pivotal axis that is oriented substantially perpendicular to the longitudinal axis of said groove.

9. A case according to claim 8 wherein a plurality of crosscuts are disposed at different longitudinal positions along said holder adjacent to said pivotal connection, said crosscuts allowing parts of said holder to be pivoted backward after a crack-and-pivot movement, said object being free in the area of said crosscuts.

10. A case according to claim 1 wherein said first clamping fixture has a position-securing device that protects against axial displacement of said object.

11. A case according to claim 10 wherein said position-securing device is a contact shoulder that opposes the longitudinal displacement of said object in said receiving bore of said base.

12. A case according to claim 1 wherein the groove defined by said holder has a crosscut that interrupts said groove where said pivotal connection is located such that said pivotal connection is formed in the side of said holder that is away from said groove, said pivotal connection defining an axis that is aligned perpendicular to the longitudinal axis of said holder such that the upper part of said holder can be folded with respect to the base of said holder.

13. A case according to claim 12, wherein said crosscut is longitudinally positioned in a lower third of a length of said groove in said holder and oriented approximately perpendicular to the longitudinal axis of the groove of said holder.

14. A case according to claim 12, wherein said pivotal connection is one of the following:

a. a film hinge;

b. an elastically bendable metal or spring part that snaps backward or assumes a closed position due to a spring action; or c. a bending metal part inserted at a wall that is facing away from the groove of said holder.

15. A case according to claim 12 wherein said pivotal connection comprises a pivot safety device that must be overcome to initially place said upper part and said base in the open position.

16. A case according to claim 15 wherein said pivot safety device comprises a cracking in a pivoting joint.

* * * * *